US010266319B2

(12) United States Patent
Buck

(10) Patent No.: US 10,266,319 B2
(45) Date of Patent: Apr. 23, 2019

(54) CUP LID WITH INTEGRATED CONTAINER

(71) Applicant: Ronald Mark Buck, Encinitas, CA (US)

(72) Inventor: Ronald Mark Buck, Encinitas, CA (US)

(73) Assignee: SNACKTOPS, INC., Carlsbad, CA (US)

( * ) Notice: Subject to any disclaimer, the term of this patent is extended or adjusted under 35 U.S.C. 154(b) by 0 days.

(21) Appl. No.: 14/986,703

(22) Filed: Jan. 3, 2016

(65) Prior Publication Data

US 2016/0114947 A1 Apr. 28, 2016

Related U.S. Application Data

(63) Continuation-in-part of application No. 13/680,011, filed on Nov. 17, 2012, now Pat. No. 9,622,605, and a continuation-in-part of application No. 13/360,707, filed on Jan. 28, 2012, now Pat. No. 8,381,935, which is a continuation-in-part of application No. 13/226,346, filed on Sep. 6, 2011, now Pat. No. 8,596,491.

(60) Provisional application No. 62/105,256, filed on Jan. 20, 2015.

(51) Int. Cl.

| | |
|---|---|
| ***A47G 19/22*** | (2006.01) |
| ***B65D 21/02*** | (2006.01) |
| ***B65D 51/28*** | (2006.01) |

(52) U.S. Cl.

CPC ..... *B65D 51/28* (2013.01); *A47G 19/2205* (2013.01); *A47G 19/2222* (2013.01); *B65D 21/0222* (2013.01); *B65D 2203/00* (2013.01); *B65D 2231/022* (2013.01); *B65D 2543/00046* (2013.01); *B65D 2543/00092* (2013.01); *B65D 2543/00296* (2013.01); *B65D 2543/00537* (2013.01)

(58) Field of Classification Search

CPC ..... B65D 81/3227; B65D 2577/205; B65D 2251/1008

See application file for complete search history.

(56) References Cited

U.S. PATENT DOCUMENTS

| | | | | |
|---|---|---|---|---|
| 6,076,450 A * | 6/2000 | DiGiorgio, Jr. | ..... | A47J 31/02 210/244 |
| 6,374,726 B1 * | 4/2002 | Melton | ..... | A47G 19/16 220/712 |
| 2004/0099544 A1 * | 5/2004 | Ness | ..... | B65D 81/3227 206/216 |

OTHER PUBLICATIONS

International Preliminary Report on Patentability dated Jul. 25, 2017 in PCT/US2016/013116 (7 pages).

* cited by examiner

*Primary Examiner* — Jeffrey R Allen
(74) *Attorney, Agent, or Firm* — Manuel de la Cerra

(57) ABSTRACT

A cup lid with an integrated container that can be coupled to a beverage cup has a continuous outer coupling ring which circumscribes a footprint of the lid, and a drink-hole planar surface above the coupling ring and within the lid footprint. An annular surface above the coupling ring, within and non-concentric with the lid footprint, is connected to the drink-hole planar surface. A food container has a container inner wall extending downward from the annular surface, and a bottom connected to the container inner wall and coplanar with or below the coupling ring. A drink hole for drinking a liquid in the cup extends through the drink-hole surface at a position outside of the annular surface, and a cover is removably attached to the annular surface and encloses the food container.

7 Claims, 19 Drawing Sheets

FIG. 1G
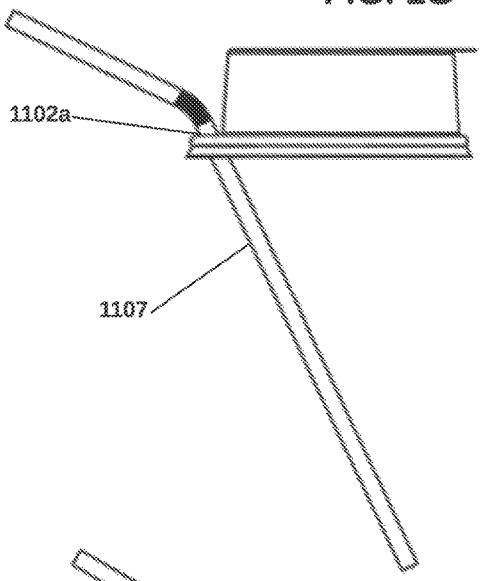
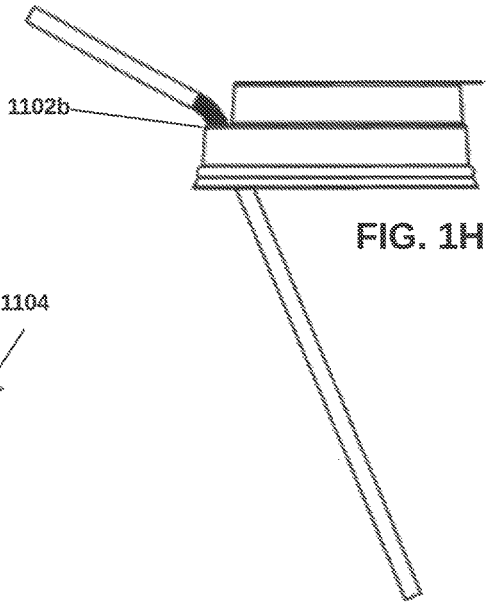
FIG. 1H
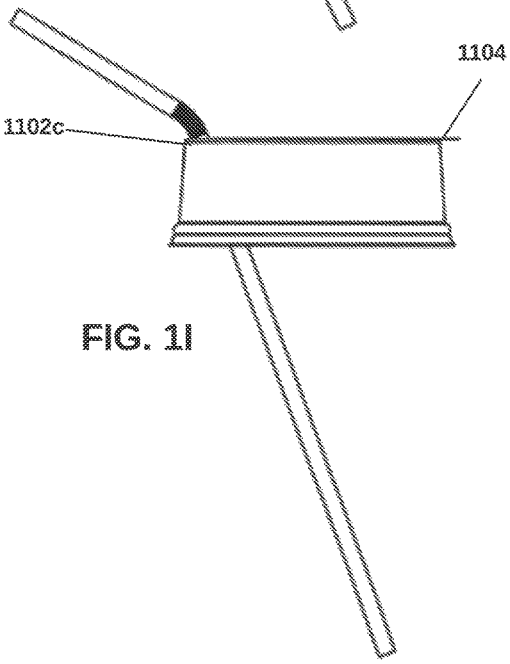
FIG. 1I

FIGURE 9A
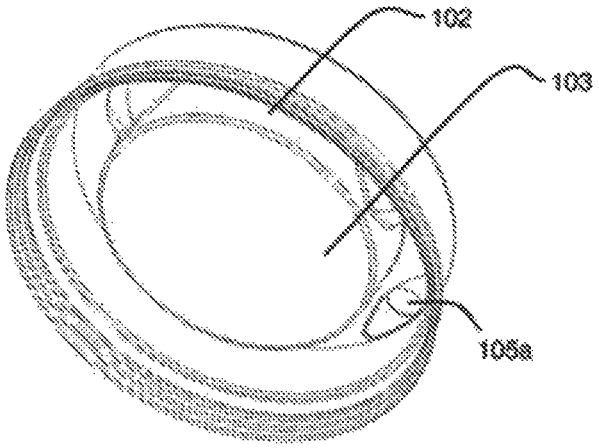
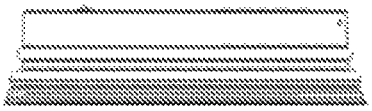
FIGURE 9B
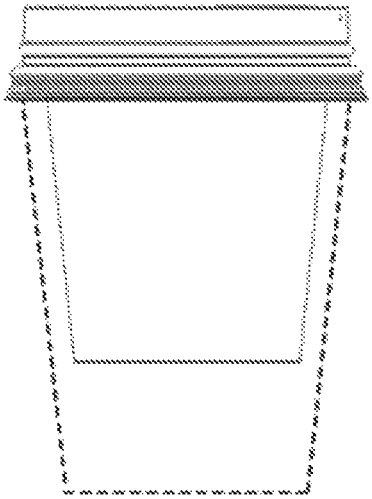
FIGURE 9C

CUP LID WITH INTEGRATED CONTAINER

1.0 TECHNICAL FIELD

The present invention relates to lids for disposable containers, and particularly to a new and novel cup lid with a food container.

2.0 RELATED APPLICATIONS

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; U.S. patent application Ser. No. 14/274,576 entitled "A CONTAINER LID WITH A FOOD COMPARTMENT AND A SIP-HOLE" filed on May 9, 2014; U.S. patent application Ser. No. 14/313,907 entitled "A CONTAINER LID SYSTEM WITH A LID PORTION AND FOOD CONTAINER PORTION" filed on Jun. 24, 2014; U.S. Patent Application Ser. No. 62/005,862 entitled "A CONTAINER LID SYSTEM WITH A LID PORTION AND FOOD CONTAINER PORTION" filed on May 30, 2014; U.S. Patent Application 62/038,199 entitled "A CONTAINER LID SYSTEM WITH TAMPER INDICATOR" filed on Aug. 15, 2014; U.S. patent application Ser. No. 29/500,266 entitled "BENDABLE DRINKING STRAW" filed on Aug. 22, 2014; and U.S. Patent Application 62/105,256 entitled "BENDABLE SAFETY STRAW AND LIDS WITH FOOD COMPARTMENT" filed on Jan. 20, 2015; all of which are by the same inventor of the present application. Each of these applications is incorporated herein by reference.

3.0 BACKGROUND

The increased popularity of fast-food establishments, coupled with the popularity of consumption of food and beverages on-the-go, have led to the need for more convenient takeout packaging.

Billions of disposable beverage cups are used every year. Often those cups are part of a larger meal, and current technology dictates placing a lid on the beverage cup, and packing the food in a separate and detached container. This may be satisfactory for a consumer seated at a table. However, when the consumer must eat on-the-go, use of the current technology is problematic. Consider, for example, a consumer who is drinking a beverage and would like to access a breakfast sandwich in a takeout bag. The consumer must set aside the beverage, and then use one hand to hold the bag and the other hand to access the sandwich, then set aside the bag and use both hands to open the sandwich packaging. In this example, current technology does not allow for convenient on-the-go consumption. Standard cup lids are simple covers that do not include an integrated container. Rather, known lids cover the contents of a cup which forms a closed container in combination with the cup itself.

To address some of these problems, yogurt manufacturers have placed a small food container on the lid of a yogurt cup. The food container (often holding nuts or granola) must be removed from the yogurt cup and then flipped over and opened, then the contents are poured into the yogurt cup. It is therefore not possible to simultaneously access the contents of the yogurt cup and the contents of the food container; rather, the food container must be completely disengaged from the cup to access either the contents of the yogurt cup or the contents of the food container. The food container that attaches to the yogurt cup in an upside-down position has a limited food-volume capacity because its walls taper as they proceed upward toward the bottom of the upside-down container. Without this tapering, the yogurt cup/food container complex would become top-heavy and cumbersome.

Other known devices having a container or shelf combined with a lid have limitations which makes these devices impractical to use. One category of devices includes a container combined with a cup, but utilizes a hole in the middle of the lid. This makes it impossible to store non-ring or non-annular items having no central hole, in the container, such as hamburgers, cookies or muffins, for example. Another category of devices includes a container combined with a lid, but does not allow for simultaneous access to the contents of the cup and the container, nor for the container to be resealed or a drop-in container to be removed from the container. Other devices that include drop-in functionality require removal of the container before accessing the contents of the cup. Other devices have relatively small peel containers for pills such as mints and are not suitable for larger food items. Another category of devices utilizes dividers in the cup with access on each side of the cup. No known devices have a non-permanent or male/female bottom oriented coupling system for coupling a container with the lid.

Also known in the art is a flask-type container with a small compartment for a pill or pills. This design is unsuitable for storage of and simultaneous access to larger volumes of beverages and more substantial snacks/food items such as would be consumed by a take-out customer, and does not have a shape compatible with armrest cup-holders.

Thus simultaneous or intermittent access to the contents of known cups and the contents of an attached container is not possible. This makes for difficult consumption of coffee, soda, snacks, popcorn, etc., in malls, fast food restaurants, theaters, amusement parks, sports stadiums or in any other venue. For example, this makes it difficult to eat and drink food in a theater or stadium with one cup-holder per seat.

For at least the limitations described above, there is a need for a cup lid with integrated container.

4.0 SUMMARY

The present invention provides an elegant solution to the needs described above and provides numerous additional benefits and advantages as will be apparent to persons of skill in the art.

A cup lid with an integrated container that can be coupled to a beverage cup has a continuous outer coupling ring which circumscribes a footprint of the lid, and a drink-hole planar surface above the coupling ring and within the lid footprint. An annular surface above the coupling ring, within and non-concentric with the lid footprint, is connected to the drink-hole planar surface. A food container has a container inner wall extending downward from the annular surface, and a bottom connected to the container inner wall and coplanar with or below the coupling ring to avoid spillage. A drink hole for drinking a liquid in the cup extends through the drink-hole surface at a position outside of the annular surface. The drink hole may be a straw hole or a sip hole. A cover is removably attached to the annular surface and encloses the food container. The cover may be a seal-on/peel-off membrane, and may be sealed on the lid in any rotational orientation due to the circular shape of the food container.

In one embodiment, the drink-hole planar surface is approximately co-planar with the coupling ring and connected to the annular surface by a container outer wall extending upward from the drink-hole planar surface to the annular surface. In another embodiment, the drink-hole planar surface is above the coupling ring and connected to the coupling ring by an exterior wall extending upward from the coupling ring to the drink-hole planar surface, and connected to the annular surface by a container outer wall extending upward from the drink-hole planar surface to the annular surface. In another embodiment, the drink-hole planar surface is above the coupling ring and connected to the coupling ring by an exterior wall extending upward from the coupling ring to the drink-hole planar surface. In this embodiment, the drink-hole planar surface is contiguous with the annular surface.

Also disclosed is a rack for holding the lids in a compact arrangement as for sale. For display on a rack, the drink-hole planar surface may be positioned at an optimal distance between the coupling ring and the annular ring that allows the lid to hang in a substantially vertical orientation when suspended via a horizontal post through the drink hole, when the container is filled with a food item.

The foregoing summary is illustrative only and is not meant to be exhaustive. Other aspects, objects, and advantages of this invention will be apparent to those of skill in the art upon reviewing the drawings, the disclosure, and the appended claims.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

FIG. 1G is a side view of the lid of FIG. 1A with a conventional straw.

FIG. 1H is a side view of the lid of FIG. 1B with a conventional straw.

FIG. 1I is a side view of the lid of FIG. 1C with a conventional straw.

FIG. 1O is an isometric view of a rack holding a plurality of FIG. 1A lids.

FIG. 9A illustrates a bottom view of an embodiment of the invention.

FIG. 9B shows a side view of an embodiment of the invention, having a vertical dimension that extends to the plane of the cup opening.

FIG. 9C shows a side view of an embodiment of the invention, having a vertical dimension that extends down into the plane of the cup opening.

6.0 DETAILED DESCRIPTION

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims. In the following description, numerous specific details are set forth in order to provide a thorough understanding of the present invention. Particular example embodiments of the present invention may be implemented without some or all of these features or specific details. In other instances, components well known to persons of skill in the art have not been described in detail in order not to obscure unnecessarily the present invention.

Figure 3:
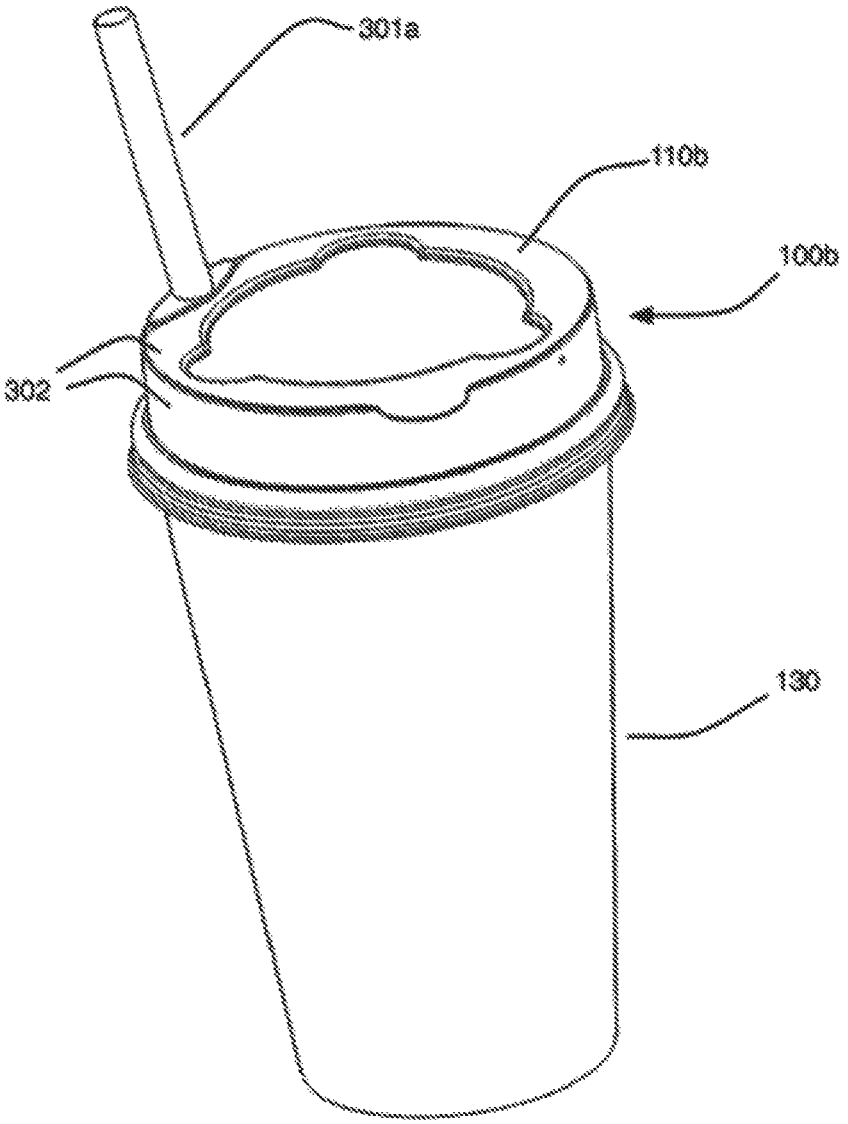
FIG. 3 illustrates a perspective view of an embodiment of the invention, coupled with a cup, a seal-on/peel-off cover and configured to allow access to the contents of the cup via a straw.
Figure 4:
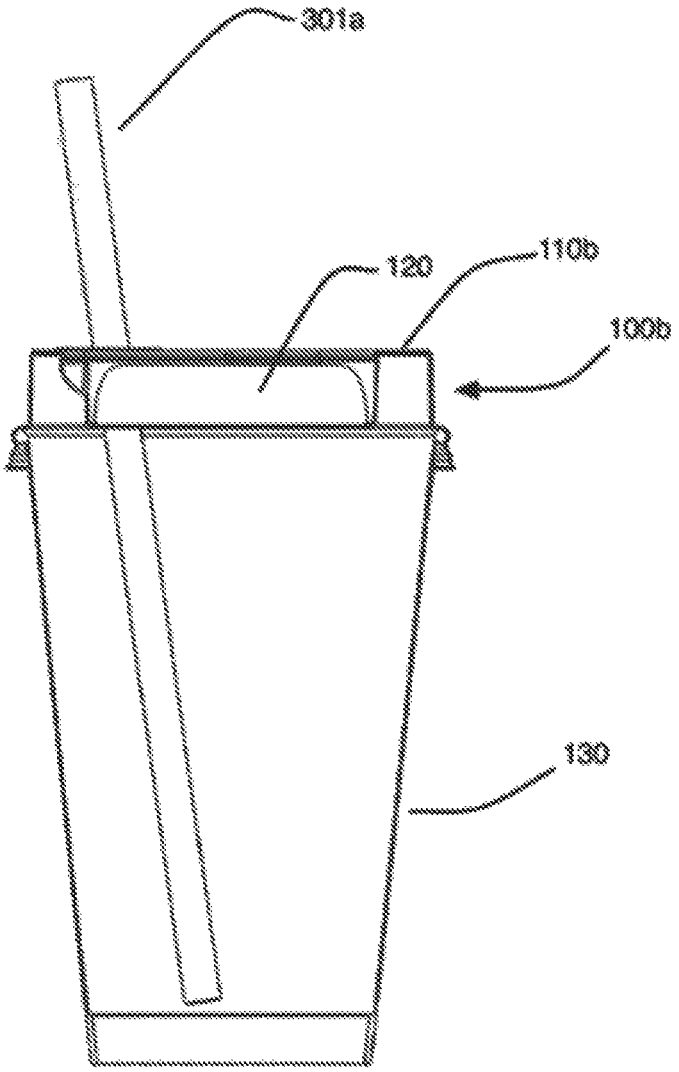
FIG. 4 illustrates a cross sectional view of FIG. 3.

An embodiment of a cup lid with integrated container 100*b* is shown in FIG. 3, coupled with a cup 130, with a seal-on/peel-off membrane 110*b* and configured to allow access to the contents of the cup via a straw 301*a*. FIG. 4 illustrates a cross sectional view of FIG. 3. As shown, the cup may be a soda, lemonade, coffee, or beer cup, for example, and is not limited to cups with a rolled rim, which are shown herein in an exemplary manner. A first solid or liquid 120 may include any combination of one or more cookies, chocolates, chips, crackers, nuts, popcorn, candies, ice cream, frozen yogurt, fruit pieces, burgers, French fries, sandwiches, milk, cream or any other item. A second liquid or solid in cup 130 may include any combination of ice cream, milkshake, frozen ice, ice coffee, milk, lemonade, water, soda, coffee, beer, mixed alcoholic beverage, or any other item.

Figure 5:
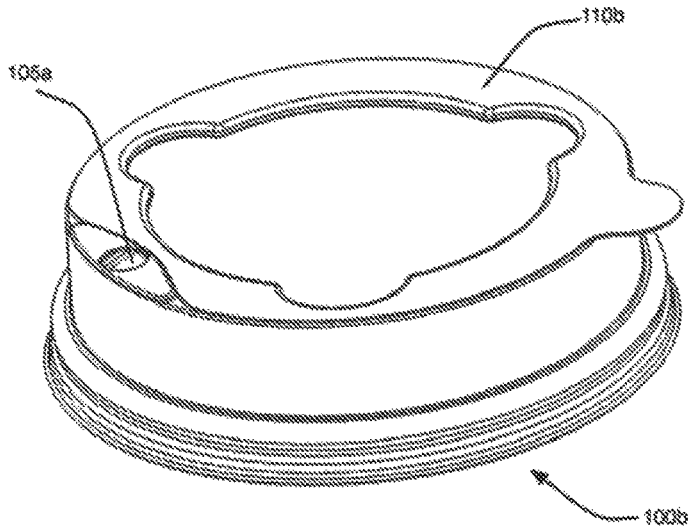
FIG. 5 illustrates a top perspective view of the embodiment shown in FIG. 3.
Figure 6:
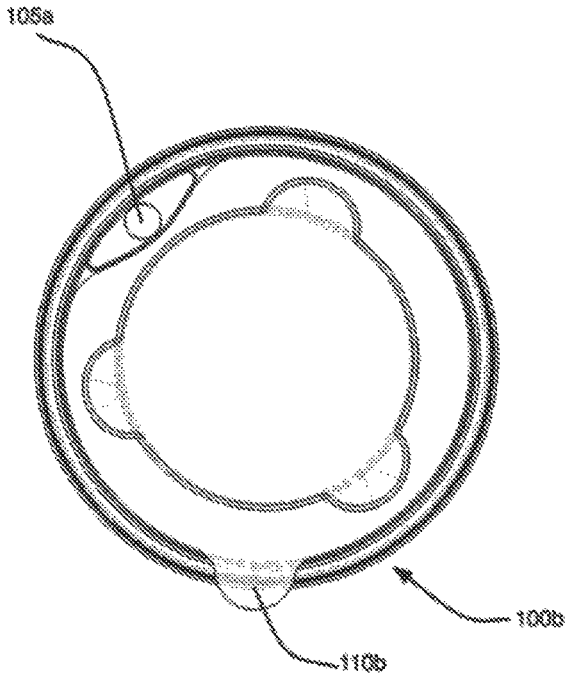
FIG. 6 illustrates a top view of the embodiment of the invention shown in FIG. 3.

FIG. 5 illustrates a top perspective view of the embodiment of the invention shown in FIG. 3. The planar, horizontal area on top of the embodiment shown includes a hole 105*a*, which may be a straw hole or sip hole, to allow access to the second liquid or solid, i.e., the contents of the cup. Without removing the cup lid, a person may also access the contents of the container on top of the cup. FIG. 6 illustrates a top view of the embodiment of the invention shown in FIG. 3. The peel-off tab is shown at the bottom of the figure and allows for the seal-on/peel-off membrane 110*b* to be removed from the cup lid.

Figure 7A:
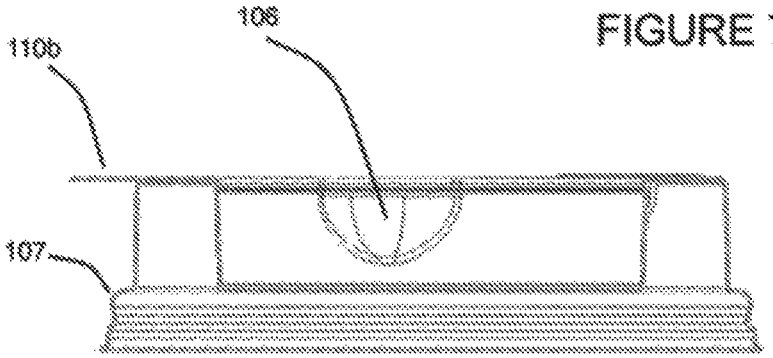
FIG. 7A illustrates a side cross sectional view of the embodiment of the invention shown in FIG. 3.
Figure 7B:
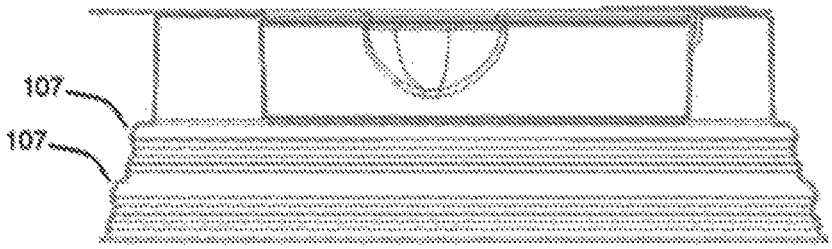
FIG. 7B illustrates a side cross sectional view of an embodiment of the invention, shown having two or more coupling elements configured to couple with cups of different sizes.
Figure 7C:
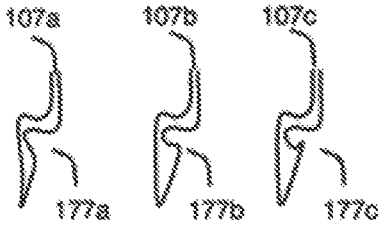
FIG. 7C illustrates different embodiments of coupling elements that may be utilized to attach the top container to the cup rim.

FIG. 7A illustrates a side cross-sectional view of the embodiment of the invention shown in FIG. 3. FIG. 7B illustrates a side cross-sectional view of the embodiment of the invention shown having two or more coupling elements configured to couple with cups of different sizes. In this figure, more than one coupling element, here 107, having different diameters are employed so that embodiments of the invention may fit different sized cups. For example, the embodiment shown in FIG. 7B may be sized to couple with large or small coffee cups or large or small soda cups. In addition, three or more coupling elements 107 may also be employed having three or more differing diameters, so that embodiments of the invention may couple with small, medium and large cups as one skilled in the art will appreciate. In this manner, only one size of cup lid, albeit with as many diameter coupling elements as desired, may be utilized to accommodate the different sized cups utilized. Although the embodiment shown has vertically offset coupling elements, other embodiments may utilize coupling elements that are horizontally offset without a vertical offset, as one skilled in the art will appreciate. FIG. 7C illustrates different embodiments of coupling elements that may be utilized with embodiments of the cup lid. The cross section of a coupling element 107*a* is similar to the coupling element 107, and may be easier to decouple from the cup lid based on the large angle at the bend 177*a*. The cross section of a coupling element 107*b* is a harder-to-remove version of the coupling element 107 based on the smaller angle at the bend 177*b*, which requires more force to remove from the rolled edge of a cup, for example. The cross section of a coupling element 107*c* shows a semi-permanent or permanent coupling element based on the hook-like sharp angle at the bend 177*c*. Depending on the stiffness of the material utilized in construction of the cup lid, the sharp angle at the bend 177*c* may allow for the entire cup, even if full of liquid, to be lifted by the cup lid. This prevents spills by keeping the cup lid and cup attached even with large forces involved. As one skilled in the art will appreciate, multiple diameter coupling elements (as shown in FIG. 7B) on one cup lid may utilize any combination of the coupling elements 107*a*, 107*b* or 107*c* in any embodiment of the invention. For example, in one embodiment, the smallest diameter coupling element on the top portion of FIG. 7B may utilize the coupling element 107*a* or 107*b* while the lower coupling element on the bottom portion of FIG. 7B may utilize the coupling element 107*b* or 107*c*, for example to allow for more strength for large cups that may weigh more. Any number of different diameters may be utilized with any embodiment of the coupling element and any other coupling element known in the art may be utilized if desired and based on the application, as one skilled in the art will appreciate.

Figure 8:
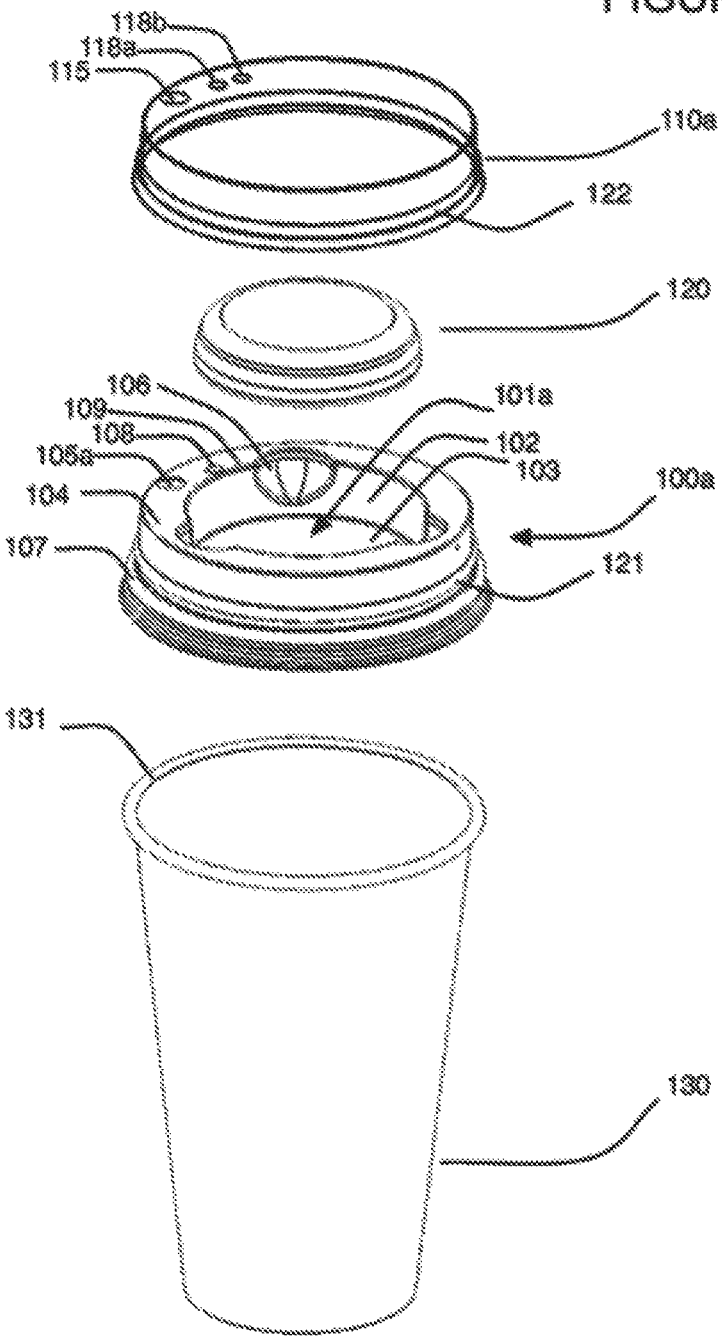
FIG. 8 illustrates an exploded view of an embodiment of the cup lid with integrated container, above a cup, along with a food item and a cover.

FIG. 8 illustrates an exploded view of an embodiment of a cup lid 100*a* with an integrated container or cavity 101*a* shown above the cup 130, along with any solid/liquid 120 or food item such as a cookie, for example, that fits into the cavity 101*a*, and a cover 110*a* that covers the food item while the food item is in the container 101*a*. The cup lid 100*a* includes a coupling element 107 that allows the cup lid to couple with the cup, and includes at least one wall 102 that leads to a container bottom 103, which may also be considered part of the wall 102. As used herein, the term "wall" is not limited to a surface of any shape, but rather refers to the separation between the container 101*a* and the contents of the cup 130. Specifically, embodiments of the invention include at least one wall that defines the container 101*a* that is configured to store a first solid or a liquid separate from a second solid or liquid stored in the cup 130 wherein the cup 130 generally includes an annular opening that lies in a plane on top of the cup. The cup as shown also includes a rolled rim 131 that a coupling element 107 is configured to couple with to hold the cup lid 100*a* onto cup 130. Specifically, the coupling element 107 is configured to couple at least one wall to the annular opening on top of the cup, for example by stretching over the smaller diameter portion of the coupling element to allow the rolled edge of the cup to fit into the slightly larger diameter portion of the cup lid. The coupling element 107 is an exemplary form of attachment and any form of attachment may be utilized to couple the cup lid 100*a* to the cup 130, as one skilled in the art will appreciate, including a coupling element that includes a more difficult type of coupling to remove or even a permanent coupling. The container cover 110*a* is optionally configured to couple via a coupling element 122 to a coupling element 121 of the cup lid 100*a*. An alternative is to extend the vertical sidewall of 110*a* such that the coupling element 122 is configured to couple to the coupling element 107 of cup lid 100*a*. The horizontal area 104 includes a hole 105*a* for a straw or sip hole and optional indented cut-outs 106. At least one wall is configured to enable access of the first solid or liquid and the second solid or liquid without disengagement of the coupling element. For example, the contents of both the integrated container 101*a* and the cup 130 are accessible without removing the cup lid. The cover 110*a* as shown is configured as an external wall friction press-on cover, but may also be configured as a seal-on/peel-off membrane, press-on friction dome, press-on friction dome with hole, internal and external wall friction press-on, internal wall friction press-on, hinge or rotational cover, so long as the cover is configured to at least partially enclose the container and retain the contents of the container when the cover is coupled with a corresponding version of the cup lid.

FIG. 9A illustrates a bottom view of an embodiment of the invention. At least one wall 102 includes a vertical dimension that extends to, into, out of, or both into and out of the plane defined by the annular opening of the cup. FIG. 9B shows a side view of an embodiment of the invention having a vertical dimension that extends down to the plane of the cup opening. FIG. 9C shows a side view of an embodiment of the lid container with a cup shown in dashed lines, having a vertical dimension that extends into the plane of the cup opening; this vertical dimension may be of any size. Furthermore, at least one wall 102 includes a horizontal dimension, for example across the diameter of the container, having a width less than, equal to, or greater than a width measured across the annular opening of the cup. The embodiment shown in FIG. 9C may itself hold popcorn and fit into a standard popcorn cup that is then utilized for soda, and/or may fit into a cup that has a narrower, or stepped configuration on the bottom half of the cup so as to fit into a standard stadium or movie theater seat cup holder for example. Any type of cup that allows for an embodiment of the invention to be utilized in conjunction with a cup holder for an automobile, or stadium seat, movie theater seat or any other type of cup holder is in keeping with the spirit of the invention.

Figure 1A:
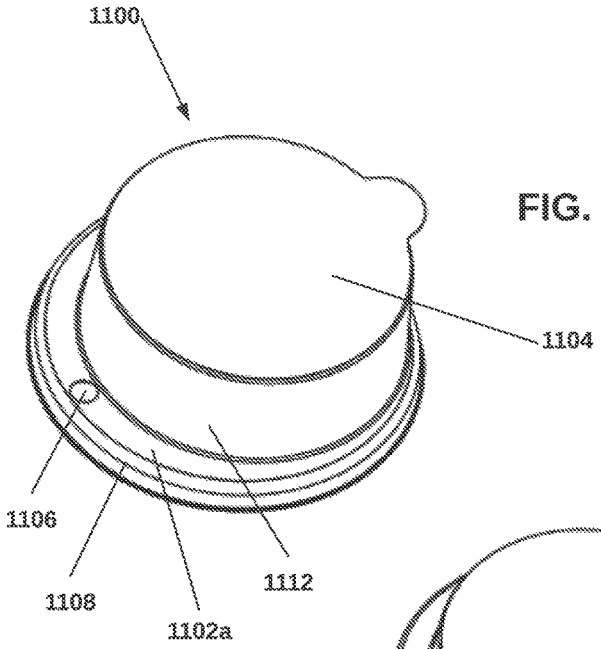
FIG. 1A is an isometric view of a lid for a beverage cup, wherein the lid has a compartment that may hold food, and wherein the compartment is sealed by a seal-on/peel-off membrane, with a straw hole in a lower position.
Figure 1B:
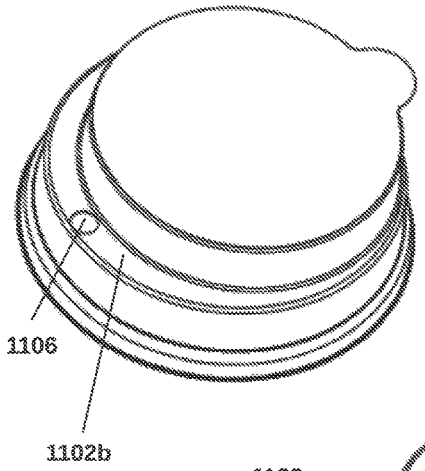
FIG. 1B is an isometric view of a lid for a beverage cup, wherein the lid has a compartment that may hold food, and wherein the compartment is sealed by a seal-on/peel-off membrane, with a straw hole in a middle position.
Figure 1C:
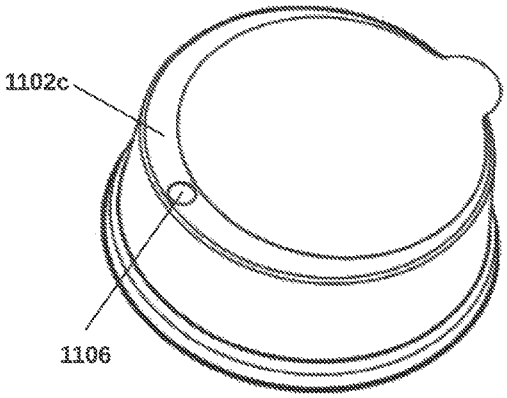
FIG. 1C is an isometric view of a lid for a beverage cup, wherein the lid has a compartment that may hold food, and wherein the compartment is sealed by a seal-on/peel-off membrane, with a straw hole in an upper position.
Figure 1D:
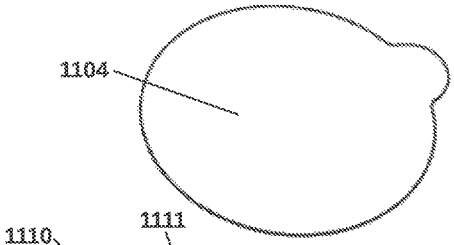
FIG. 1D shows the lid of FIG. 1A with the seal-on/peel-off membrane removed.
Figure 1E:
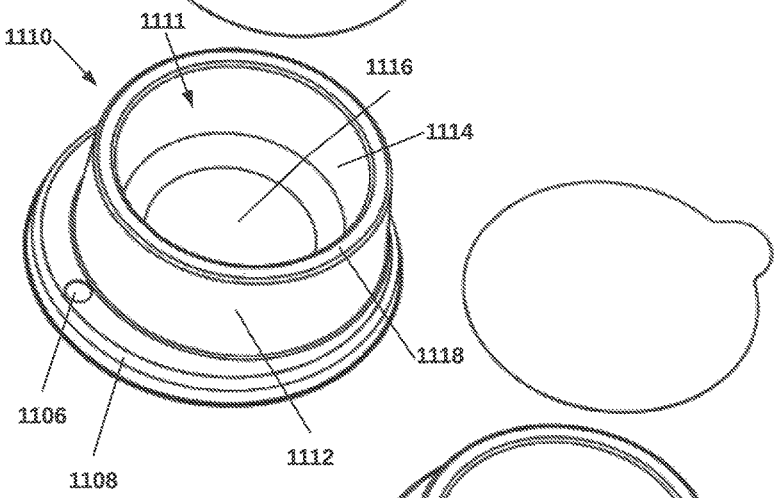
FIG. 1E shows the lid of FIG. 1B with the seal-on/peel-off membrane removed.
Figure 1E:
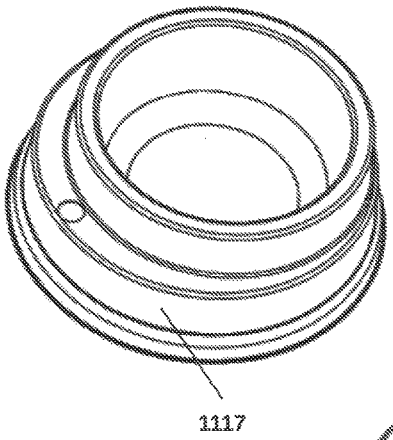
Figure 1F:
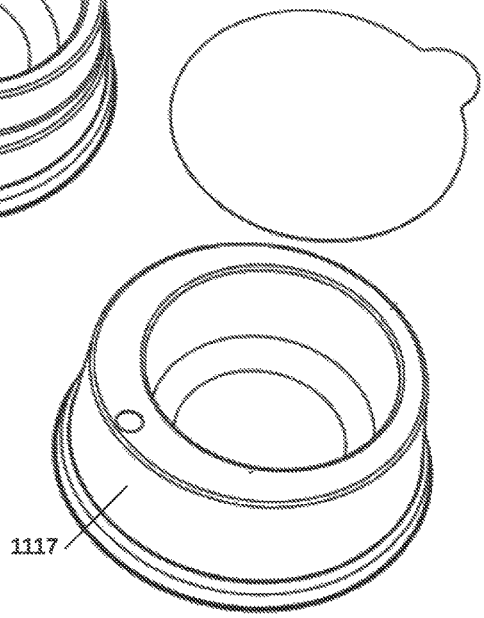
FIG. 1F shows the lid of FIG. 1C with the seal-on/peel-off membrane removed.
Figure 1J:
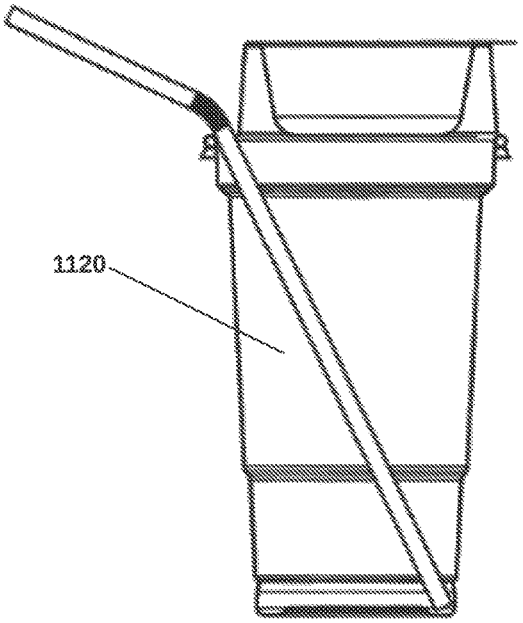
FIG. 1J is a section view of the lid of FIG. 1A on a beverage cup and with a conventional straw.
Figure 1K:
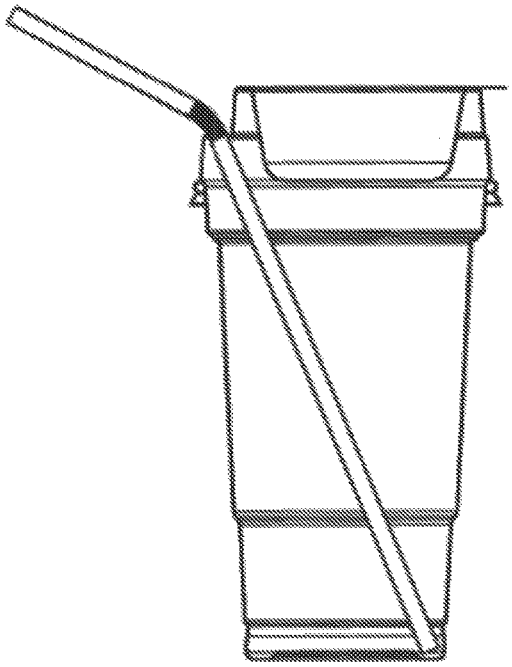
FIG. 1K is a section view of the lid of FIG. 1B on a beverage cup and with a conventional straw.
Figure 1L:
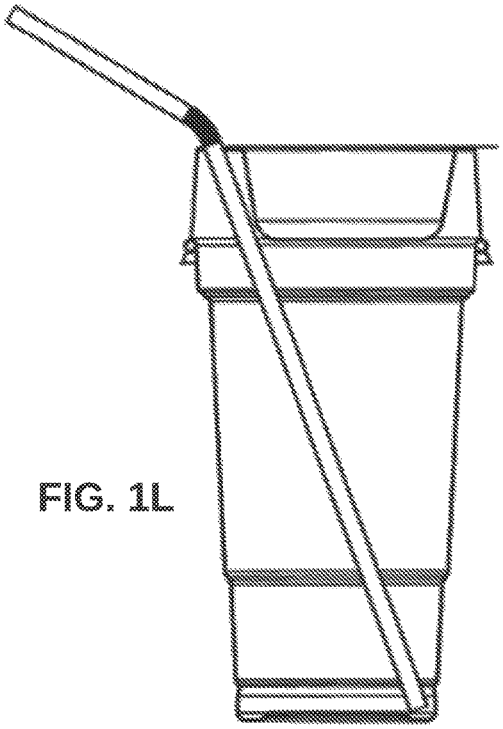
FIG. 1L is a section view of the lid of FIG. 1C on a beverage cup and with a conventional straw.
Figure 1M:
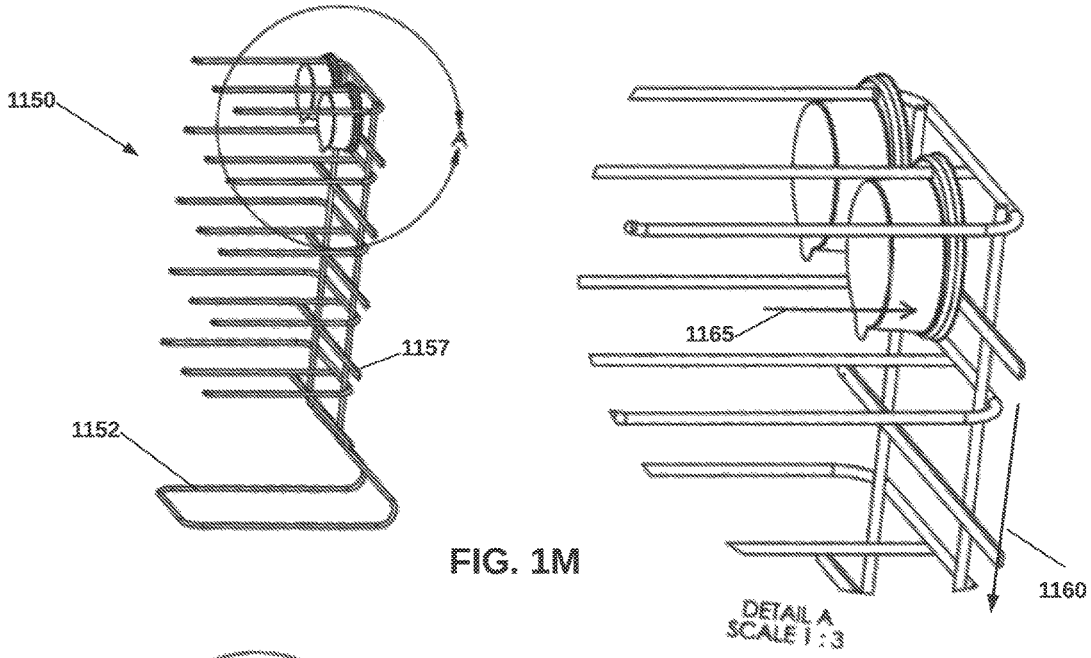
FIG. 1M is an isometric view of the lid of FIG. 1A hanging from a rack.
Figure 1N:
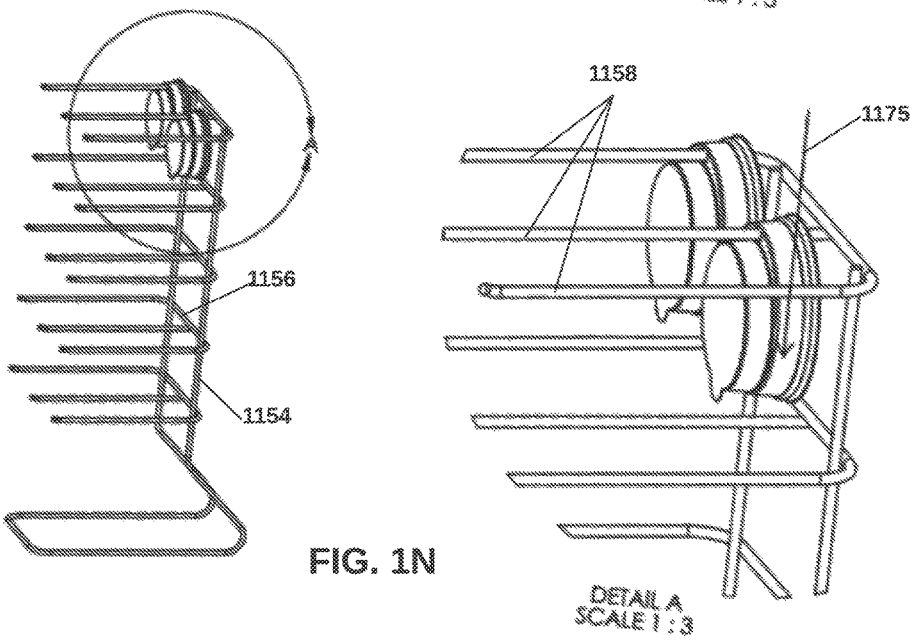
FIG. 1N is an isometric view of the lid of FIG. 1B hanging from a rack.
Figure 10:
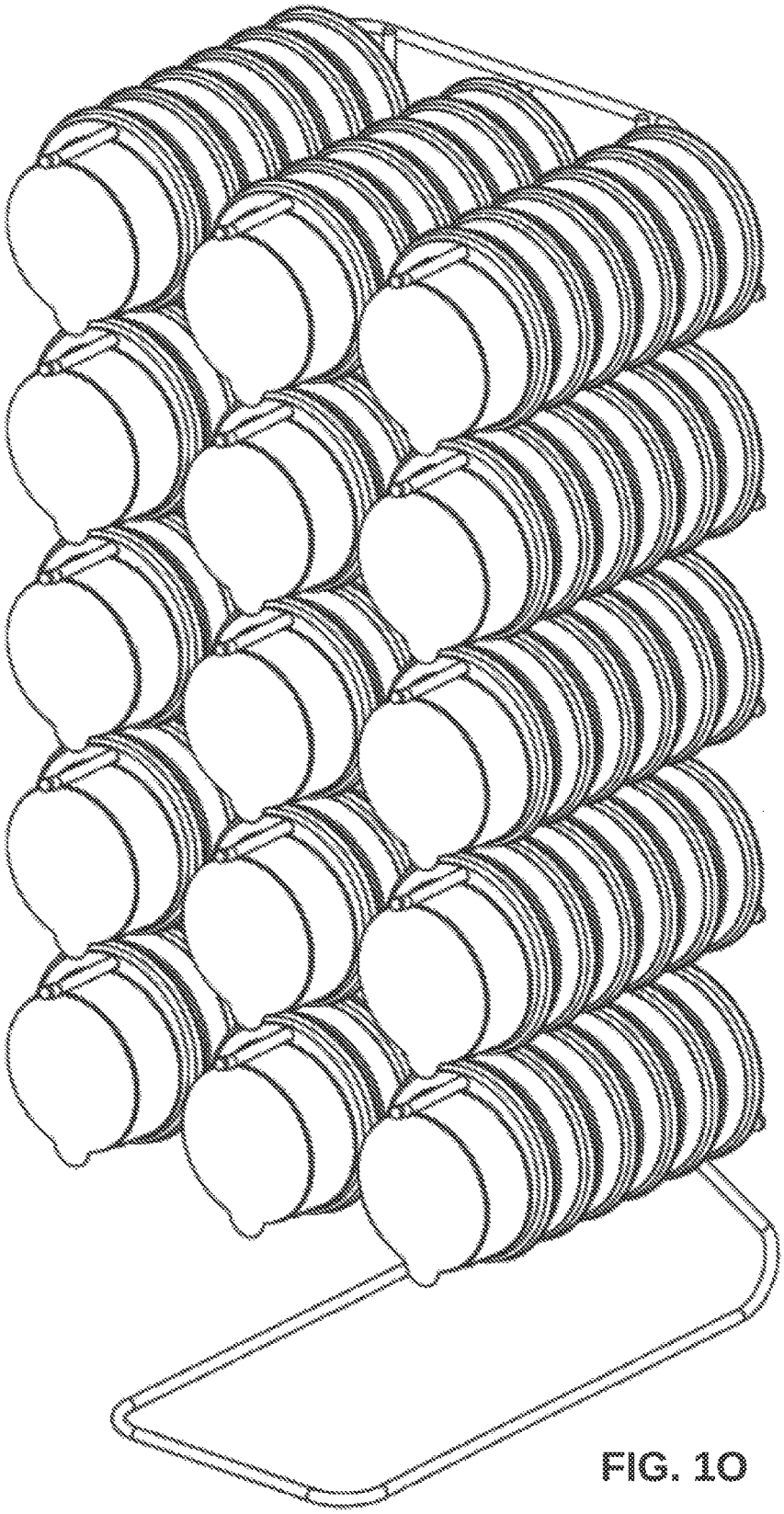
Figure 1P:
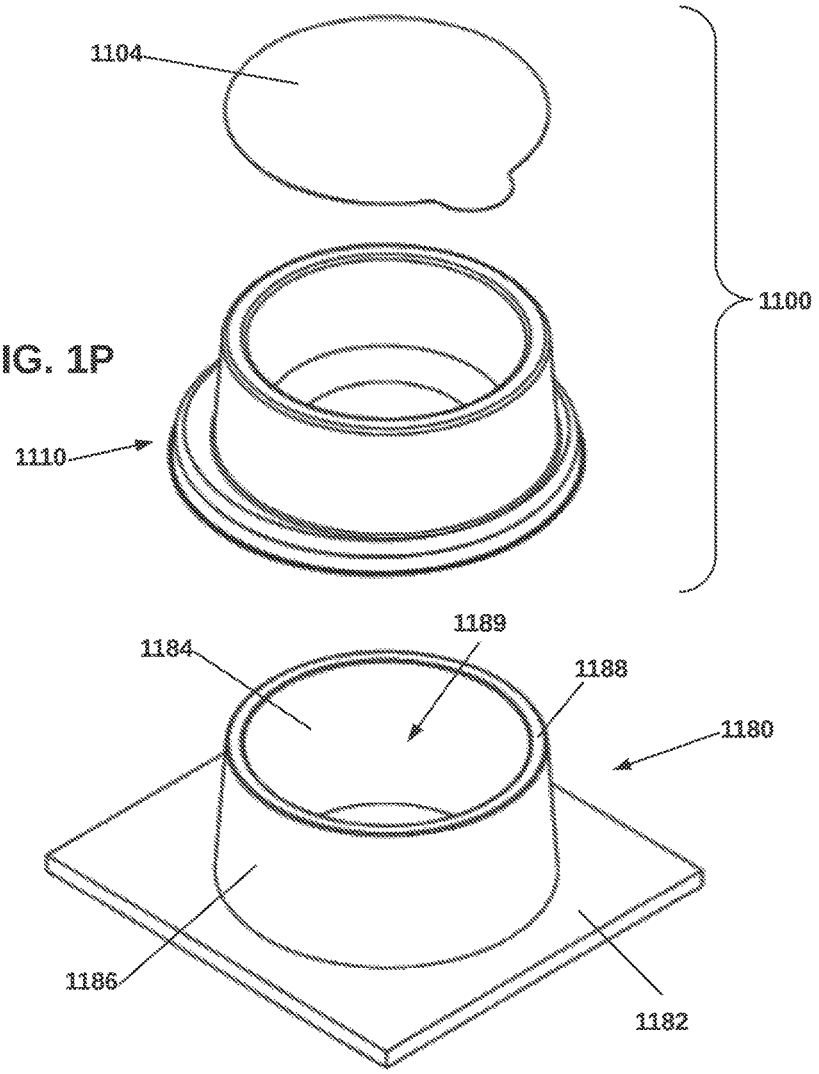
FIG. 1P is an exploded view of the lid of FIG. 1A with a tool for installing the seal-on/peel-off membrane.

FIGS. 1A-1P illustrate another embodiment of the invention in which the food container is circular and off-center. A lid 1100 for a beverage cup has a container portion 1110 that may hold food which is sealed by a seal/peel-off membrane 1104. This press-fit seal is disclosed in U.S. Pat. No. 8,596,491 entitled "CUP LID WITH INTEGRATED CONTAINER" issued on Dec. 3, 2013, by the same inventor of the present application. This patent is incorporated herein by reference.

FIG. 1A illustrates an embodiment of the cup lid with integrated container, where a straw hole 1106 passes through a horizontal area or straw-hole surface 1102*a*. The straw-hole surface is approximately co-planar with a coupling ring 1108 used to mate the lid 1100 with a beverage cup. The coupling ring 1108 circumscribes a footprint of the lid 1100. Although a circular straw hole is shown, the hole could be of another suitable shape, such as a rounded rectangular sip hole for drinking without a straw. The coupling ring 1108 may be a coupling element as discussed above with reference to U.S. patent application Ser. No. 13/680,011.

FIG. 1B illustrates another embodiment where the straw hole 1106 is through a shelf 1102*b* between the plane defined by the coupling ring 1108 and the seal-on/peel-off membrane 1104. FIG. 1C illustrates an embodiment where the straw hole 1106 is through a shelf 1102*c* approximately co-planar with the seal-on/peel-off membrane 1104.

FIG. 1D shows the embodiment of the cup lid where the straw hole is in the lower position, with the seal-on/peel-off membrane 1104 removed. The seal-on/peel-off membrane 1104 attaches releasably to the annular surface 1118 which is connected to the straw-hole surface 1102*a* via an outer food container wall 1112. The cavity or food container 1111 is further defined by an inner container wall 1114 which descends from the annular surface 1118 to a substantially flat bottom 1116, which is at or below the level of the coupling ring 108 to avoid spillage of the contents of the container. The inner container wall 1114 defines a second footprint, which forms a nested circle within the footprint of the lid 1100. As shown in FIG. 1D, the second footprint defined by the inner container wall 1114 is non-concentric to the larger footprint of the lid 1100.

FIG. 1E shows the embodiment of the cup lid where the straw hole 1106 is in the middle position, and FIG. 1F shows the embodiment where the straw hole 1106 is in the upper position, with the seal-on/peel-off membrane 1104 lifted off. For both of these embodiments, an exterior wall 1117 extends from the coupling ring 1108 to the straw-hole plane 1102*b*, 1102*c*. The exact position of the straw hole in this last embodiment may be optimized as discussed below.

FIGS. 1D, 1E and 1F further show that the design of the lid 1100 is such that the seal-on/peel-off membrane 1104 can be sealed on the lid 1100 in any rotational orientation. As shown, the food container 1111 is circular, thus making the manufacture of the lid 1100 much easier because when food is placed in the container 1111 the seal-on/peel-off membrane 1104 need not be oriented in a certain direction prior to installation.

FIGS. 1G, 1H and 1I illustrate the lid 1100 with a typical straw 1107 inserted through the straw hole 1106 in the straw hole plane 1102*a* (lower position), 1102*b* (middle position), and 1102*c* (upper position). FIGS. 1J, 1K and 1L are cutaway views of these three lid embodiments with the straw and a cup 1120.

Further disclosed is a rack 1150 designed to be used with the lids 100. As shown in FIGS. 1M and 1N, the rack 1150, which may be made of metal, plastic or another suitable material, has a base 1152 so that the rack may stand upright on a countertop or other horizontal surface. Vertical supports 1154 rise from the base 1152 and are connected by horizontal supports 1156 from which extend posts 1158. The lids 1100 can be suspended from the posts 1158 in a compact display for sale, for example. In FIG. 1M, the first embodiment of the lid 1100 is shown which has the straw hole 1106 approximately co-planar with the coupling ring 1108 used to mate the lid 1100 with the beverage cup (FIG. 1A, 1D, 1G, 1J). The problem with this embodiment is that when the container 1111 is filled with food (for example, nuts or candy), gravity (shown by arrow 1160) will cause the lid 1100 to rotate about the straw hole 1106 in the direction of arrow 1165. Thus when the lids 1100 are displayed on the rack 1150, they will be tilted, unless a secondary support 1157 is added to the rack 1150 to prevent such rotation. In FIG. 1N, the straw hole 1106 is between the plane defined by the coupling ring 1108 and the seal-on/peel-off membrane 1104 (FIG. 1B, 1E, 1H, 1K). The exact position is selected such that the lid 1100, when filled with food, has a weight distribution which causes it to dangle on the rack 1150 in a substantially vertical orientation (arrow 1175), as may be seen also in FIG. 1O.

Figure 1Q:
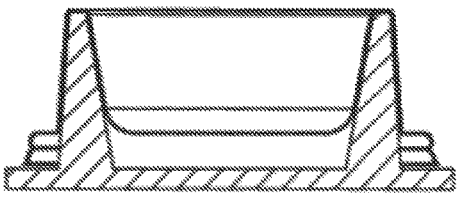
FIG. 1Q is a side view of the tool of FIG. 1P with the lid fully seated.
Figure 1R:
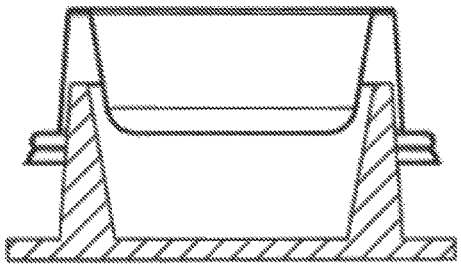
FIG. 1R is a side view of the tool of FIG. 1P with the lid partially removed.

FIGS. 1P, 1Q and 1R illustrate tooling to allow the quick and easy installation of the seal-on/peel-off membrane. A support structure 1180 has a shape complementary to the container portion 1110, such that the container portion 1110 fits over the support structure 180 which reinforces the container portion 1110. This reinforcement allows the seal-on/peel-off membrane 1104 to be installed during manufacture by a press fit, without damaging the container portion 1110. As shown in FIG. 1P, the support structure 1180 has a base 1182 and a cavity 1189 defined by an inner wall 1184 connected by an annular upper surface 1188 to an outer wall 1186. As shown in FIGS. 1Q and 1R, when the container portion 1110 is placed over the support structure 1180, the coupling ring 1108 rests against the base 1182 and the annular surface 1118 is supported by the upper surface 1188, while the container inner wall 1114 and outer wall 1112 touch the tooling inner wall 1184 and outer wall 1186, respectively. This allows the seal-on/peel-off membrane 1104 to be sealed over the food container 1111 without risk of damage to the container portion 1110 when pressure is applied to create the seal.

Figure 2A:
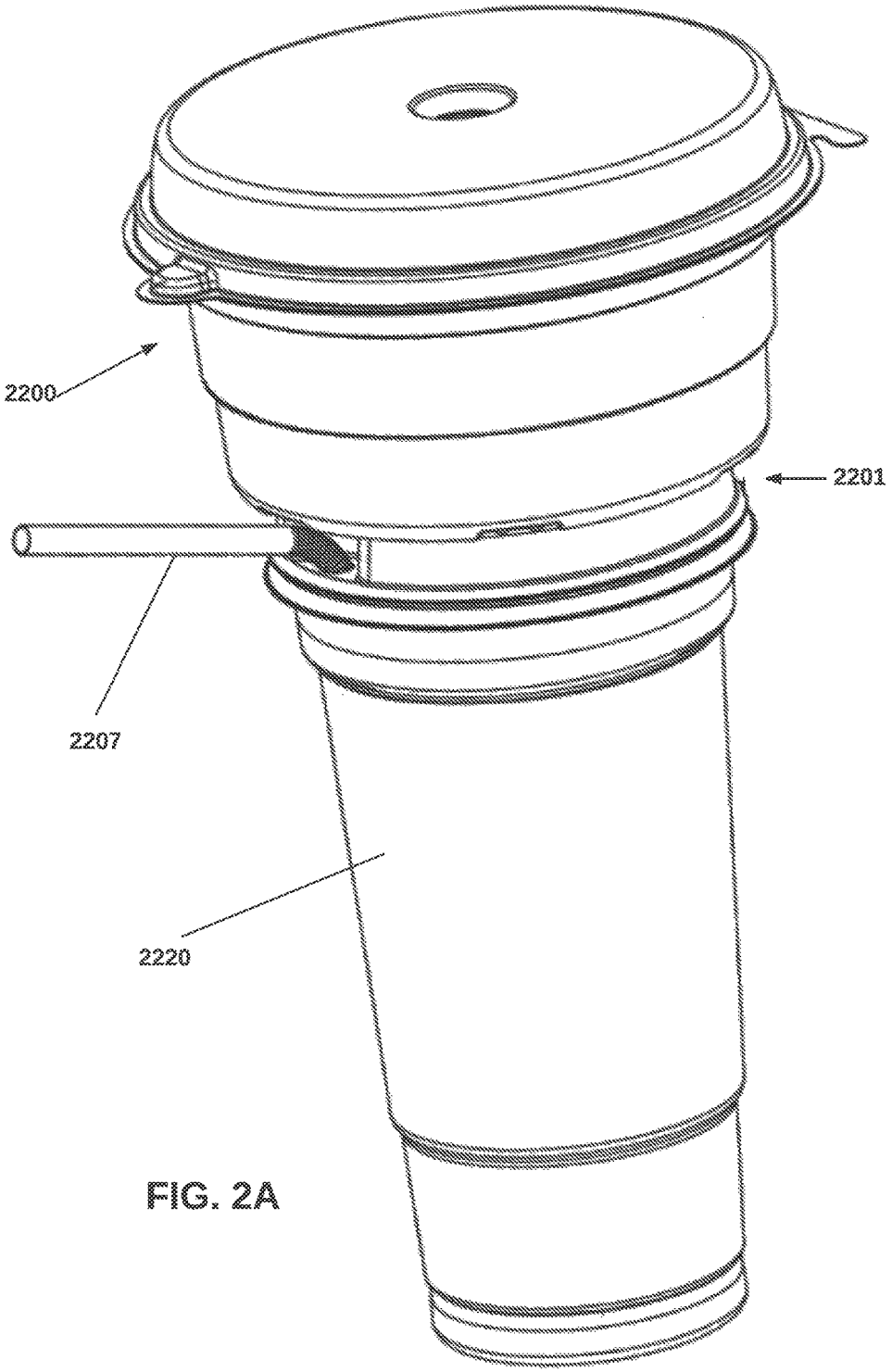
FIG. 2A is an isometric view of a lid for a beverage cup, wherein the lid has a compartment that may hold food and which may have one or more removable shelves, shown on a beverage cup and with a conventional straw.
Figure 2B:
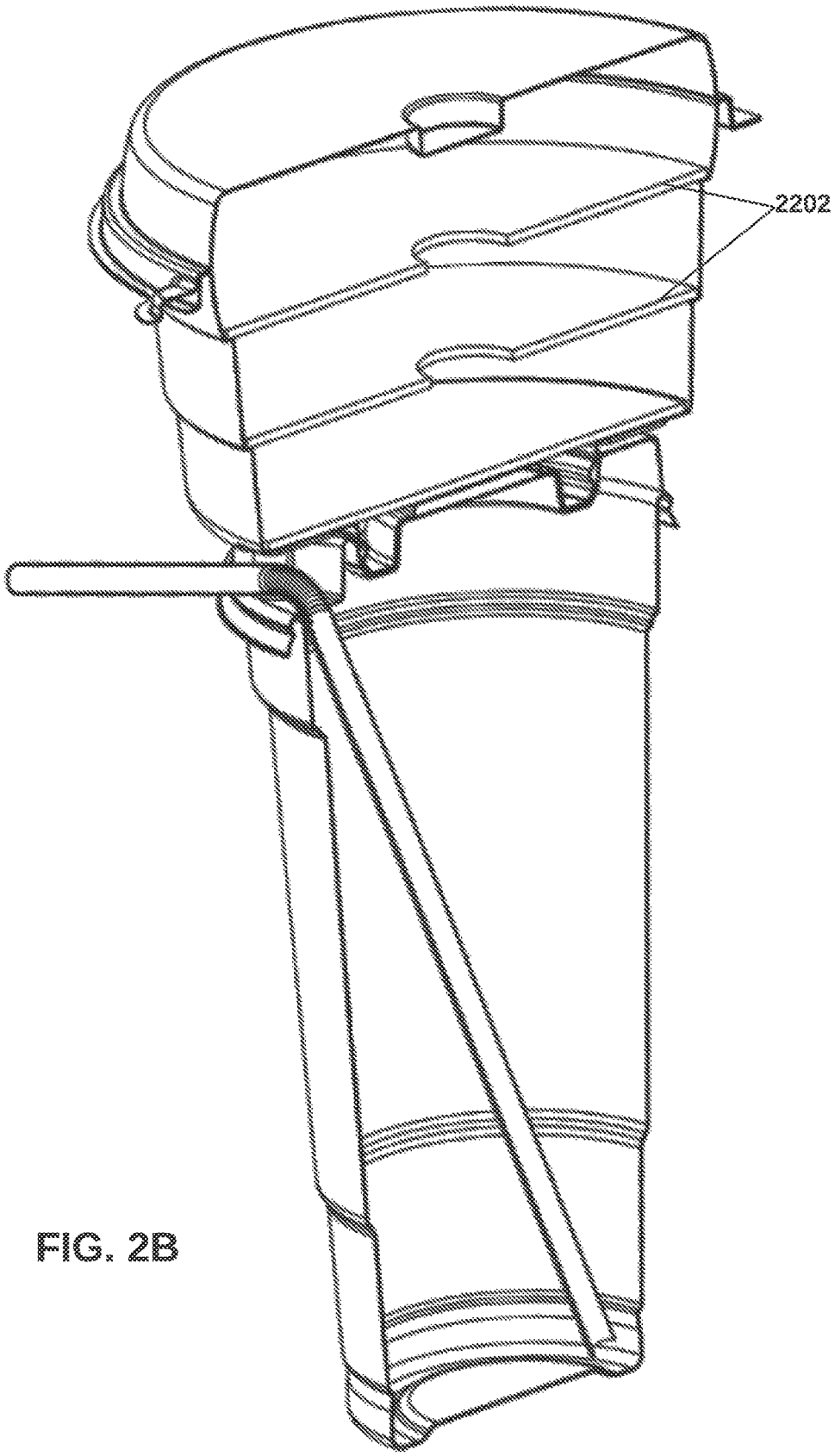
FIG. 2B is a section view of the lid of FIG. 2A.
Figure 2C:
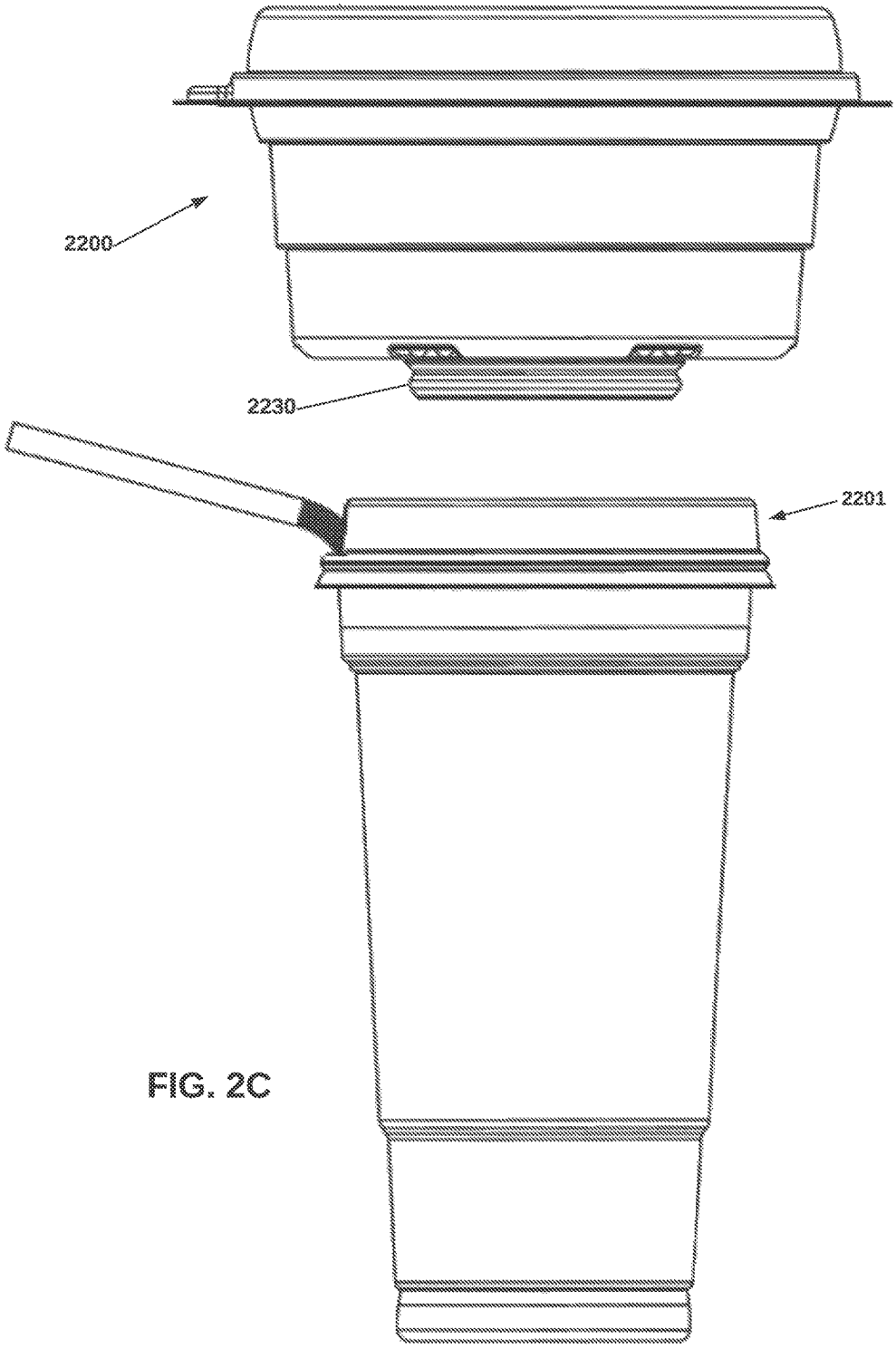
FIG. 2C is a side view of the lid of FIG. 2A with the food compartment detached from the lid.
Figure 2D:
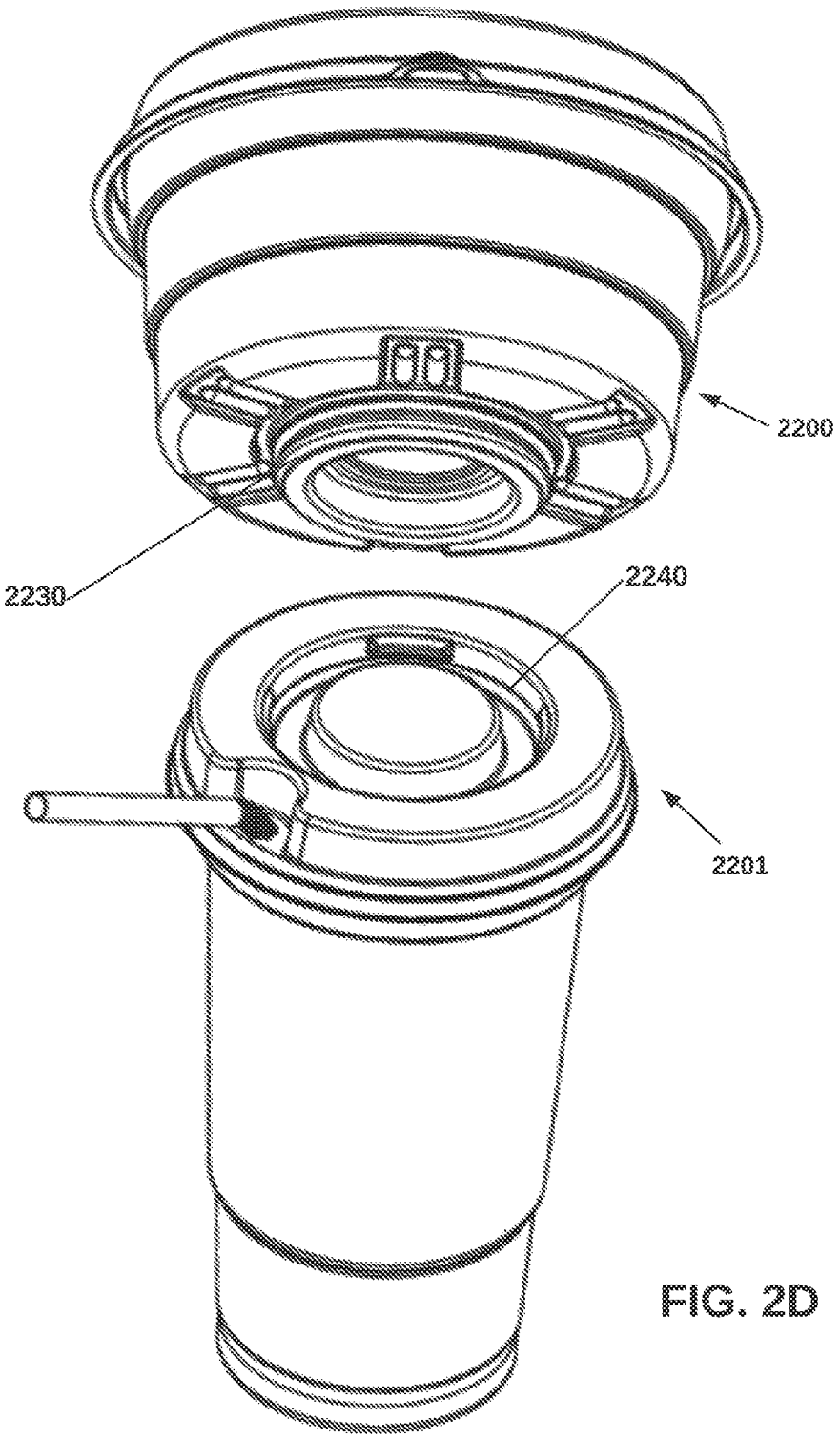
FIG. 2D is an isometric view of the lid of FIG. 2A, with the food compartment detached from the lid and rotated to show the mating surfaces.
Figure 2E:
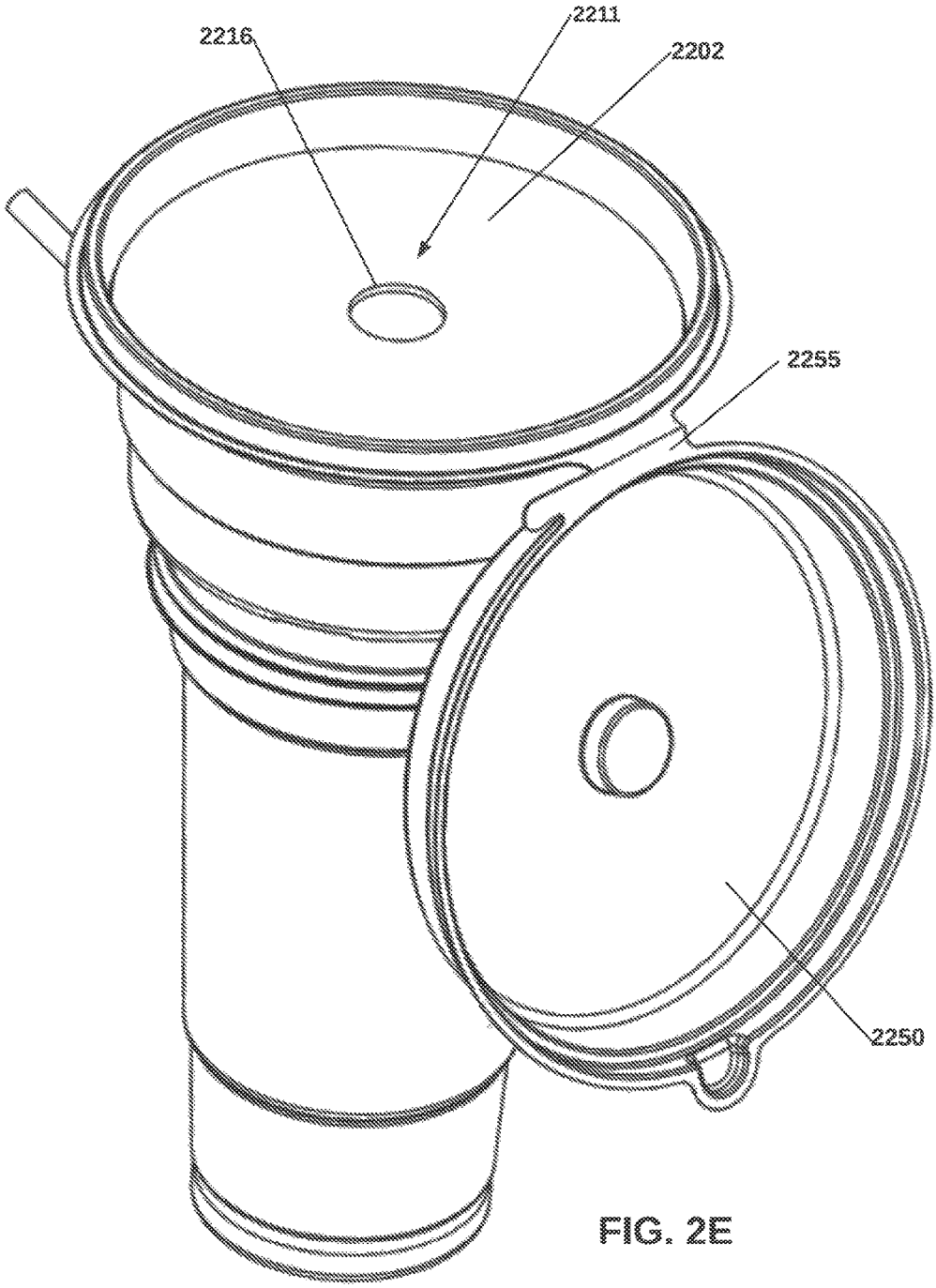
FIG. 2E is an isometric view of the lid of FIG. 2A with the food compartment open to reveal the top shelf.
Figure 2F:
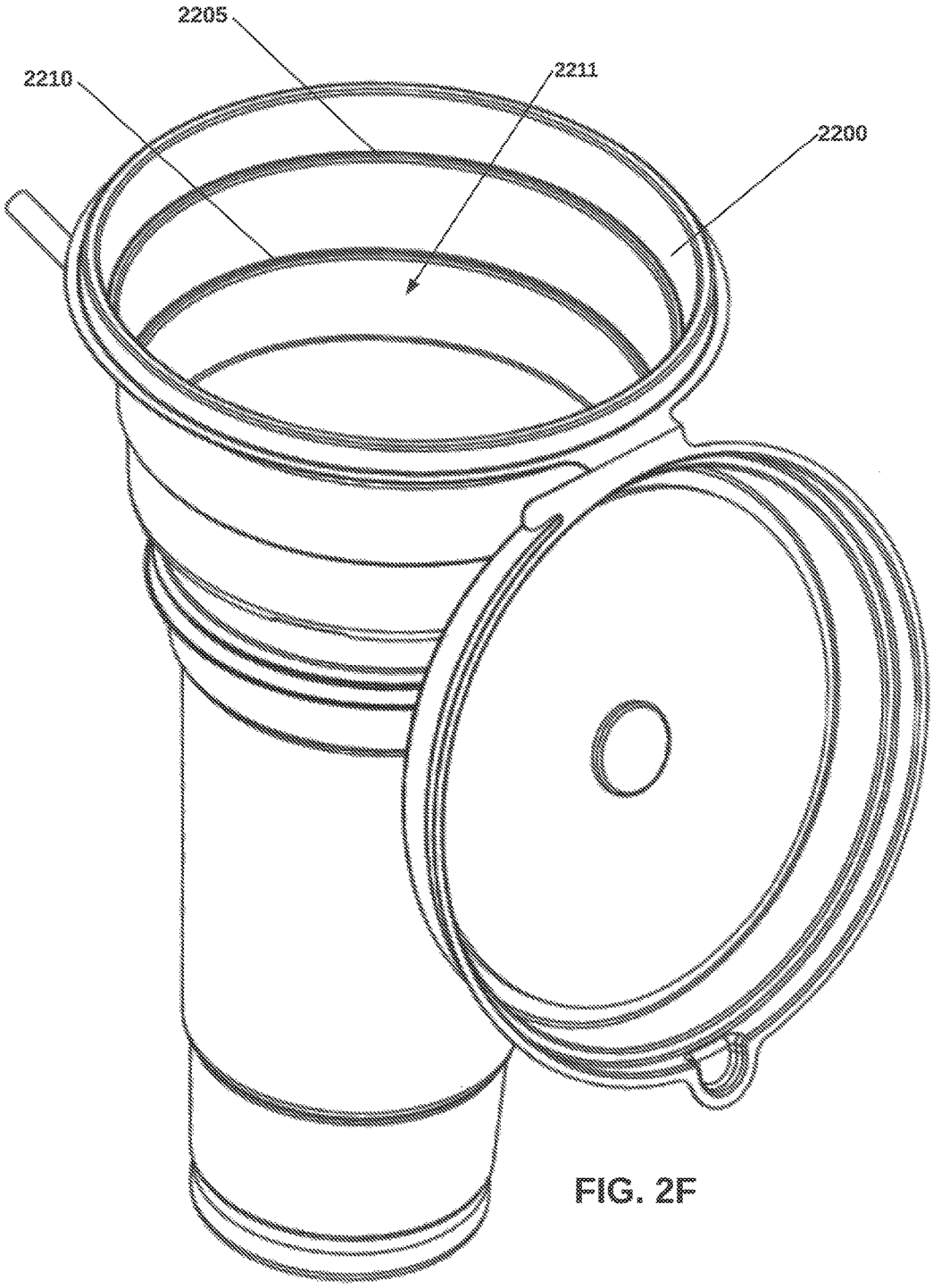
FIG. 2F is an isometric view of the lid of FIG. 2A with the food compartment open and the shelves removed.

FIGS. 2A-2F illustrate another lid for a beverage cup, wherein the container lid 2200 has a compartment 2211 that may hold food. As shown in FIG. 2A, the container lid 2200 attaches to a cup lid 2201 on a cup 2220, and a straw 2207 may be used to access a drink in the cup 2220 while the container lid 2200 is attached. The compartment 2211 may have one or more removable shelves 2202 as shown in FIG. 2B, to contain multiple food items. As shown in FIG. 2E, a cover 2250 pivots about a hinge 2255 to allow access to the compartment 2211, and the shelves 2202 may have a hole 2216 to allow the user to easily remove a shelf 2202 to access food contained on a lower shelf. The food compartment 2211 of the lid 2200 may have one or more ledges 2205, 2210 upon which the shelves 2202 rest (see FIG. 2F). As illustrated in FIGS. 2C and 2D, the container lid 2200 has a coupling element 2230 which attaches to a corresponding coupling element 2240 on the cup lid 2201.

The various embodiments of the lid may be constructed out of plastics, composites or other suitable materials.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend the following claims "and the embodiments in the specification to be strictly coextensive." Phillips v. AHW Corp., 415 F.3d 1303, 1323 (Fed. Cir. 2005) (en banc).

The invention claimed is:

1. A cup lid with integrated container that can be coupled to a beverage cup, the lid comprising:

a continuous outer coupling ring for removable attachment to an open beverage cup, wherein the coupling ring circumscribes a footprint of the lid and defines a first plane;

a drink-hole planar surface above the coupling ring and within the lid footprint;

an annular surface above the coupling ring, within and non-concentric with the lid footprint, and connected to the drink-hole planar surface, the annular surface defines a second plane;

a food container comprising a container inner wall extending from the annular surface to a position lower than the annular surface defines a second footprint, and a bottom connected to the container inner wall and coplanar with or below the coupling ring;

a drink hole for drinking a liquid in the cup, extending through the drink-hole planar surface and lying within a plane between the first plane and the second plane;

a cover removably attached to the annular surface and enclosing the food container;

wherein the second footprint is nested within the footprint of the lid;

wherein the cup lid has a weight distribution such that when the lid is suspended via a horizontal post through the drink-hole and the food container is filled with a food item, the lid hangs in a substantially vertical orientation.

2. The cup lid with integrated container of claim 1, wherein the drink-hole planar surface is above the coupling ring and connected to the coupling ring by an exterior wall extending upward from the coupling ring to the drink-hole planar surface, and connected to the annular surface by a container outer wall extending upward from the drink-hole planar surface to the annular surface.

3. The cup lid with integrated container of claim 1, wherein the cover is a seal-on/peel-off membrane.

4. The cup lid with integrated container of claim 3, wherein the seal-on/peel-off membrane can be sealed on the lid in any rotational orientation.

5. The cup lid with integrated container of claim 3, wherein the seal-on/peel-off membrane is sealed on the lid by a press-fit.

6. The cup lid with integrated container of claim 1, wherein the drink hole is a straw hole.

7. The cup lid with integrated container of claim 1, wherein the drink hole is a sip hole.

* * * * *